United States Patent [19]

Goldner et al.

[11] 4,034,988

[45] July 12, 1977

[54] ELECTRONIC DICE

[76] Inventors: Sandor Goldner, 4308 10th Ave., Brooklyn, N.Y. 11219; Jacob Lax, 850 44th St., Brooklyn, N.Y. 11220

[21] Appl. No.: 627,752

[22] Filed: Oct. 31, 1975

[51] Int. Cl.[2] ..... A63B 71/06

[52] U.S. Cl. ..... 273/138 A

[58] Field of Search ..... 40/132 D; 273/138 A, 273/142 H, 85 R, 1 E

[56] References Cited

U.S. PATENT DOCUMENTS

| | | | |
|---|---|---|---|
| 3,284,083 | 11/1966 | Levin et al. | 273/138 A |
| 3,573,792 | 4/1971 | Reed | 40/132 D X |
| 3,791,650 | 2/1974 | Dice | 273/138 A |

OTHER PUBLICATIONS

Scott, W. M., "Electronic Casino"; *Radio Electronics;* Mar. 1974, pp. 45, 50–52, 86.

Plevy, A. L.; "Electronic Dice"; *Electronics World;* Oct. 1968, pp, 82–84.

Millman, J. M. and Taub, H., *Pulse Digital and Switching Waveforms;* McGraw Hill, 1965, pp. 404, 437–445.

*Primary Examiner*—Richard C. Pinkham

*Assistant Examiner*—Vance Y. Hum

*Attorney, Agent, or Firm*—Friedman, Goodman & Teitelbaum

[57] ABSTRACT

An electronic circuit contained within a housing and having two sets of optoelectronic display elements on the face of the housing arranged to represent the spots of a set of dice. The electronic circuit includes a timer which produces timing pulses of varying duration controlled by an externally available switch which determines the beginning of the timing pulse and their duration. During the duration of each timing pulses a switching circuit produces two varying sequences of clock pulses each of which is counted by a binary counter configurated to six counts in a repetitive counting cycle. At the termination of each timing pulse, the final count on each of the counters is displayed on the optoelectronic elements as the numbers on a set of dice. An audible oscillator simulates the sound of rolling dice during the course of each timing pulse. The electronic circuit uses integrated circuits and is designed to utilize a minimum number of circuit chips, and specifically three and two thirds circuit chips for a set of dice.

20 Claims, 16 Drawing Figures

COUNTER

| DIGIT | A | B | C |
|---|---|---|---|
| 0(6) | 0 | 0 | 0 |
| 1 | 1 | 0 | 0 |
| 2 | 0 | 1 | 0 |
| 3 | 1 | 1 | 0 |
| 4 | 0 | 0 | 1 |
| 5 | 1 | 0 | 1 |

"NOR" GATE

| INPUTS | | OUTPUT |
|---|---|---|
| 0 | 1 | 0 |
| 1 | 0 | 0 |
| 1 | 1 | 0 |
| 0 | 0 | 1 |

"OR" GATE

| INPUTS | | OUTPUT |
|---|---|---|
| 0 | 1 | 1 |
| 1 | 0 | 1 |
| 0 | 0 | 0 |
| 1 | 1 | 1 |

| DIGIT | DISPLAY |
|---|---|
| 0(6) | $D_1D_2D_3D_4D_5D_6$ |
| 1 | $D_7$ |
| 2 | $D_1D_2$ |
| 3 | $D_1D_2D_7$ |
| 4 | $D_1D_2D_3D_4$ |
| 5 | $D_1D_2D_3D_4D_7$ |

ELECTRONIC DICE

BACKGROUND OF THE INVENTION

This invention relates to an electronic circuit and more particularly to an electronic circuit utilizing a minimum number of integrated circuit chips to produce electronic dice.

Dice are commonly utilized in various games of chance. Generally, the dice are formed of small cubes having spots, ranging from one spot up to six spots, on each of the six faces of the cube. Since the cubes are rather small they are frequently lost or misplaced. Also, through continued usage, the cubes become dented and damaged which can result in a loss of the randomness of the dice. Furthermore, the small cubes can be easily loaded and fixed to produce particular desired combinations of numbers. It has therefore been suggested in the prior art to produce electronic dice which can simulate the random results of mechanical dice.

While various circuits have been suggested for producing such electronic dice, there circuits have generally been complex and costly, and have also failed to take into account the psychological aspect of utilizing a set of mechanical dice. In order to produce the randomness required, prior art circuits have generally used numerous clocks and gates which have resulted in a relatively high cost of electronic components and a rather complicated system to operate. Furthermore, electronic dice have not been able to produce the emotional involvement and thrills which are associated with the rolling of mechanical dice. With mechanical dice, as they are rolled, the cubes bounce and jump from side to side until finally coming to rest on one face. During the rolling, the visual effect of the continuously changes faces with continuously changing numbers enhances the psychological effect of chance and luck. Also, the sound of the rolling dice is stimulating and also adds to the psychological effect of the chance and risk in using the dice. These psychological aspects have generally been overlooked in prior art electronic dice. Typically, there is no sound associated with the electronic dice and the only visual display is the final numbers; but there will not appear any continuously changing numbers representing the rolling dice cubes.

SUMMARY OF THE INVENTION

It is accordingly an object of the present invention to provide electronic dice which avoids the aforementioned problems of prior art electronic dice.

It is a further object of the present invention to provide electronic dice which are controlled by a circuit utilizing a minimum number of integrated circuit chips.

Still a further object of the present invention is to provide an electronic dice circuit which can operate a set of dice utilizing the availabilities of only three and two thirds integrated circuit chips.

Yet a further object of the present invention is to provide electronic dice which operate in a completely random manner to determine the output of the dice.

Still another object of the present invention is to provide electronic dice using optoelectronic elements to represent the spots of the dice, and wherein the optoelectronic elements continuously display changing numbers until they stop and provide the dice output.

Yet a further object of the present invention is to provide electronic dice utilizing an unbalanced multivibrator circuit to produce two varying sequences of clock pulses during each timing pulse.

Still another object of the present invention is to provide electronic dice which are contained within a housing having optoelectronic elements, such as light emitting diodes externally viewable from a face of the housing.

Yet a further object of the present invention is to provide electronic dice which are completely random and which give the psychological effect of rolling dice.

Briefly, the invention provides electronic dice, including timing means which produces timing pulses of varying durations. A control switch means is coupled to the timing means and controls the beginning of the timing pulses, as well as their duration. A switching circuit means produces at least two varying sequences of clock pulses during the duration of each timing pulse. Counting means is coupled to the output of the switching means and repetitively counts to a predetermined count. During each timing pulse, the counting means produces an output count for each sequence of clock pulses. The output count is dependent upon the total number of clock pulses in each sequence, for each timing pulse. A display means is coupled to the counting means and displays the output count for each sequence at the termination of each timing pulse. In one embodiment, the display means also continuously displays the counting state of the counting means throughout the duration of the timing pulse to provide a continuously changing visual output until the termination of the timing pulse, at which time the output on the display remains fixed at a particular number. Interface logic is utilized to interconnect the counting means to the display means, and using integrated circuit chips can be formed with a minimum of three and two thirds circuit chips.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which:

FIGS. 7A–7G shows graphs useful in explaining the operation of the present invention.

DESCRIPTION OF THE PREFERRED EMBODIMENT

Figure 1:
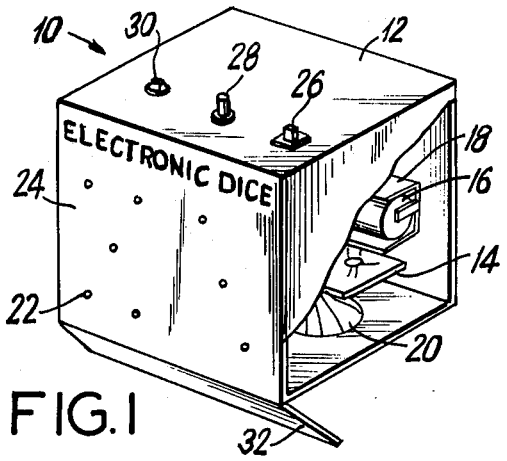
FIG. 1 is a partially cutaway isometric view of the electronic dice, in accordance with the present invention.

Referring now to FIG. 1 the electronic dice of the present invention are shown generally at 10 and include a housing 12 containing the electronic components which operate the electronic dice. Such components can be formed on a printed circuit board 14 and can include integrated circuit chips as well as discrete semiconductor components. The circuit is operated by means of a voltage source such as the batteries 16 which are held within the housing 12 by means of the support 18. A speaker 20 is included to provide an audio simulating the noise of rolling dice. The output of the electronic dice is provided by means of optoelectronic elements such as light emitting diodes 22 positioned on one face 24 of the housing 12. The optoelectronic elements are externally viewable and continuously change their output until the end of a timing cycle, at which time they will maintain a permanent display. The display shown in FIG. 1 indicates the combination of a five and a three.

A main on-off switch 26 is positioned on the housing for energizing the electronic device from the voltage source 16. To change the reading of the dice, the push button switch 28 is depressed for as long as desired, and then released. Following release of the push button switch 28, the optoelectronic elements 22 will continuously change their output numbers until after a timing cycle is completed, at which time they will maintain a fixed output. A plug-in socket 30 is also included on the housing, to receive a remote control switch which can also be utilized to change the values of the dice. An angular stand 32 is placed at the bottom of the face of the dice to lift the front end of the dice in an upward position so that when the housing is placed on a table it will be tilted upward for easy viewing.

Figure 2:
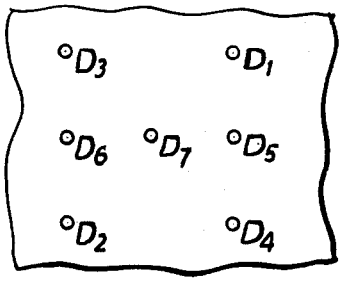
FIG. 2 is a schematic drawing showing the optoelectronic devices forming the spots of a die.

Referrung now to FIG. 2, it will be noted that the display on the face of the housing includes seven individual optoelectronic elements for each die. The optoelectronic elements ae labeled D1 through D7 to identify the seven locations of the elements. The seven elements are positioned in two parallel columns of three elements each, with a central elemet positioned at the midpoint between the two columns. The elements are identified such that a first pair of diagonally opposed elements are respectively identified as D1 and D2. The opposite set of diagonally opposed elements and identified as D3 and D4. The two elements positioned at the central part of each column are identified as D5 and D6. The centrally located element is D7.

In displacing the numeric value 1 on the die, only the element D7 is illuminated. For displaying the value of "2", the elements D1 and D2 are illuminated. For the value "3" the diagonal elements D1, D2 and D7 are all displayed. A "3" is displayed by illuminating the elements D1, D2, D3 and D4, while a "5" is displayed by illuminating the four corner elements D1 through D4 as well as the center element D7. A "6" is displayed by illuminating the elements composiing the two columns, and specifically the elements D1–D6. While FIG. 2 only shows the elements composing one die, it is understood that a similar set optoelectronic elements would be provided for each die.

Figure 3:
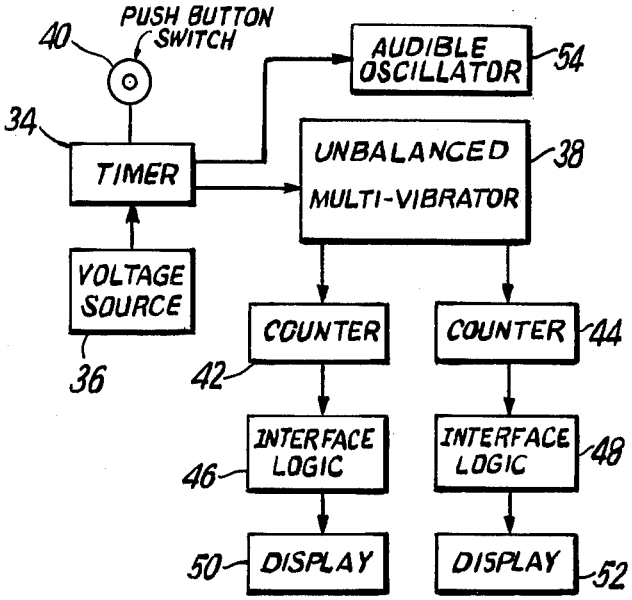
FIG. 3 is a circuit block diagram of the electronic dice, in accordance with the present invention.

In order to randomly display values on the electronic dice, the electronic circuit shown in FIG. 3 is utilized. The circuit includes a timer 34 which interconnects a voltage source 36 with a switching circuit such as an unbalanced multivibrator 38. The timer is activated by the operation of the push button switch 40 which also determines the duration of the timing pulse. During the duration of a timing pulse the unbalanced multivibrator will be energized from the voltage sourrce to produce at least two varying sequences of clock pulses. Each of the sequences of clock pulses are respectively counted by means of the counters 42 and 44. The counters are repetitive counters which can continuously count up to a predetermined count. For example, binary counters can be utilized which can count from zero through five, to thereby provide a total of six different counts. The counters can be automatically reset to continuously recycle in response to the sequences of clock pulses provided by the multivibrator 38. Interface logic circuits 46 and 48 respectively interconnected the counters 42 and 44 with the displays 50 and 52, which include the optoelectronic elements shown in FIG. 2. During the course of a timing pulse, the counter continuously changes its count state. The displays will continuously display this changing count state of the counters during each timing pulse, and at the conclusion thereof will retain a fixed value representing the final output state of the counters.

The output numbers appearing on the dice will occur in a random manner as a result of various randomly occurring situations within the circuit. The duration of the timing pulse will depend upon the amount of time the push button 40 is held depressed prior to the beginning of the timing pulse. Since this duration is undetermined, the length of the timing pulse is a first degree of randomness. The sequences of clock pulses provided by the multivibrator will vary in accordance with the duration of the timing pulse. However, since the two sequences differ from each other, a second degree of randomness is introduced in that the total number of pulses of a sequence will randomly differ from the others. A third degree of randomness occurs when the circuit is turned on. Each time it is energized, the counter begins at a different value state. Therefore, since it is not known at what initial state the counters begin their cycle, this presents a further degree of randomness. As a result, it is completely undetermined what the final state of the dice will display each time the push button switch 40 is depressed.

In order to provide the psychological effect of rolling dice, the displays continuously change in accordance with the continuously changing count state of the counters during the course of each timing pulse. The timing pulse simulates the time duration of the rolling dice and the changing display simulates the jumping and bouncing of the dice during the course of its rolling during which the upward facing die face continues to change. To add a further psychological aspect, an audible oscillator 54 can be coupled to the timer so that an audible sound, simulating the rolling dice, can be heard during the operation of the timing pulse. In this manner, after the push button switch 40 is depressed, the electronic dice will produce both the visual and audible aspects simulating the actual effect of manual rolling dice and thereby provide the psychlogical effect of the tension and thrill involved in actually rolling a set of dice.

Figure 4:
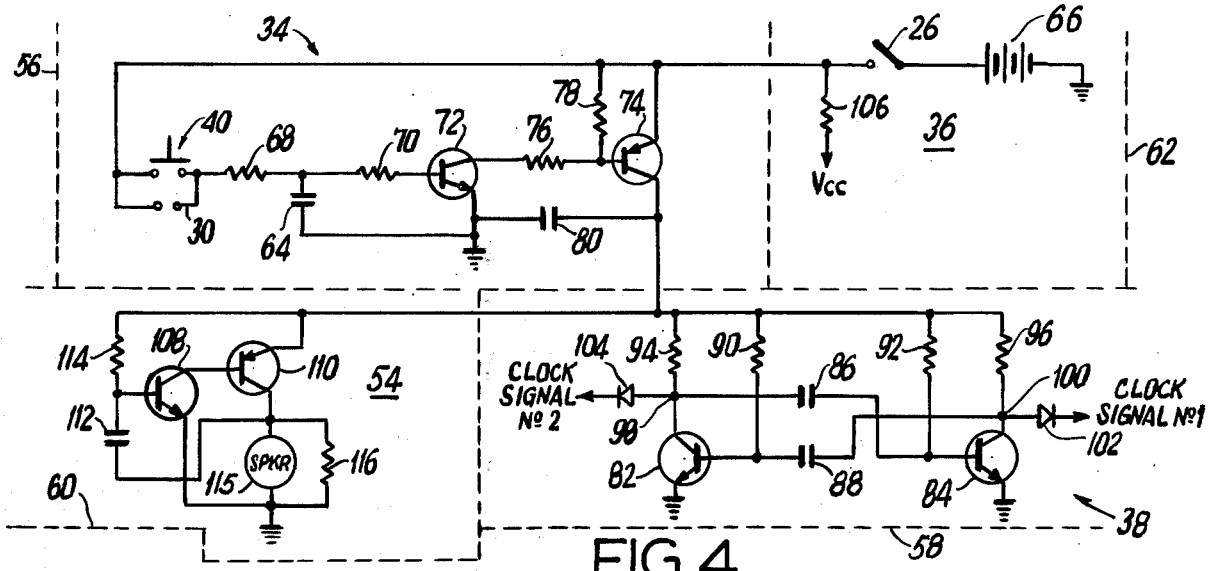
FIG. 4 is a schematic circuit diagram of one embodiment of the circuit which can be utilized as part of the circuit of FIG. 3.

The particular circuitry which can be utilized for the timer 34, as well as the unbalanced multivibrator 38, are well known in the art. Any such standard circuits can be used for this purpose. However, by way of the completeness, one typical circuit is included and is shown in FIG. 4, wherein the timer 34 is shown within the dotted lines 56, the multivibrator 38 is shown within the dotted lines 58, the audible oscillator 54 is shown within the dotted lines 60 and the voltage source 36 is shown within the dotted lines 62.

The timer 34 includes a capacitor 64 which can be charged from the voltage source 66 through the charging resistor 68 upon depression of the push button switch 40. The amount of charge built up on the capacitor 64 will depend upon the duration that the switch 40 is held depressed. For short durations, a minimum amount of charge will be built up, while for longer dirations, a greater amount of charge will be built up. Upon release of the push button switch 40, the capacitor 64 will discharge through the resistor 70 thereby turning on the transistor 72 which in turn will turn on the transistor 74. Biasing resistors 76 and 78 are included, as is known in the art, as well as a filter 80 connected between the two transistors. When the transistor 74 is turned on, the voltage source 66 will serve to energize the multivibrator 38. The transistor 74 remains on until the capacitor 64 will have discharged, at which the transistor 74 will turn off thereby completing the timing pulse. The duration during which the transducer 72 and 74 will remain on will depend upon the amount of charge previously built up on the capacitor 64. Therefore, for little charge on the capacitor the duration will be short, while for greater charges the duration will be longer. It is therefore evident that the duration of the timing pulse can be controlled to a great extent by the push button switch 40. However, it sill also be recognized that inherent inaccuracies in the components themselves may also change the amount of charge built up on the capacitor 64. Thus, for identical periods of time during which the push button 40 is held depressed, there may still be varying amounts of charge built up on the capacitor 64, depending upon the temperature, variations in the resistors, capacitors and trnsistors, as well as other atmospheric conditions which may slightly alter the total amount of charge and thereby alter the time duration of the timing pulse. However, such additional variations do not impede the circuit, and on the contrary, add to the randomness of the output appearing on the dice.

The multivibrator 38 is of a well known type including the two transistors 82 and 84 intercoupled by means of the capacitors 86 and 88, as well as the resistors 90 and 92. The collector resistors 94 and 96 are also shown, as is known in the art. The multivibrator produces an alternating series of pulses with one set of pulses appearing at the collector 98 of the transistor 82 and the other set of pulses appearing at the collector 100 of the transistor 84. Although in theory the two sets of output pulses are 180° out of phase with each other, in fact, these pulses are not in such exact relationship, but rather a shift of phase inherently occurs in the operation of the multivibrator. As a result, the two sets of pulses are not identical. Furthermore, by making the capacitors 86, 88 and/or the resistors 90, 92, different values, the multivibrator can become unbalanced, such that the time duration of one set of pulses will be shorter than the time duration of the other set. Also, by changing the values of these components, the phase shift is even further modified so that the two sets of output pulses differ even further from each other.

Referring now to FIGS. 7A–7G, it will be shown that during a given timing pulse, the two sequences of output pulses from the multivibrator can vary greatly from each other, and in a random fashion. FIG. 7A shows the timing pulse from the timer 34 during which voltage is supplied to the multivibrator and during which the two sequences of clock pulses will be produced. FIGS. 7B and 7C show one possibility of the two clock pulses, identified as clock number 1 and clock number 2. Since the multivibrator is unbalanced, pulses T1 will be of a short duration while pulses T2 will be of a longer duration. If the two pulses were exactly 180° out of phase with each other, the beginning of pulse T2 would occur identically at the end of pulse T1. Within the total timing pulse *t* there occur light T1 pulses in clock 1, and a total of eight T2 pulses occurring in clock 2.

However, as was previously indicated, there will inherently result a phase shift between the outputs which phase shift is even further modified and increased because of the unbalancing of the two multivibrators. As a result of the phase shift, the beginning of a T2 pulse of clock 2 will not be identical with the termination of a T1 clock pulse but some overlap will occur. The overlap can occur at either end of each pulse so that the pulse T2 ca begin before the pulse T1 has turned off, or the pulse T1 can begin before the pulse T2 has turned off. In this manner, it is noted that within the same timing period *t* there may occur a total of nine T1 clock pulses in clock 1, and a total of nine T2 clock pulses in clock 2. The last pulse in clock 2, although not a complete pulse will begin before the end of the timing pulse, and when the voltage to the multivibrator is turned off at the end of the timing pulse, this last partial pulse will return to zero. Although it will be a shorter pulse than the others, it will still affect the counting since the counters generally operate upon the negative going occurrence in a pulse and this will occur as soon as the multivibrator is turned off.

FIGS. 7F and 7G show a third possibility, wherein the first pulse of the clock 2 will be of shorter duration, and the multivibrator will very soon switch to its other state. In this manner, there is noted that there would be a total of eight T1 pulses in clock 1 and a total of nine T2 pulses in clock 2.

Although there were only shown three examples of the different sequences, numerous other possibilities may occur in a random fashion. As a result, within a given timing pulse *t*, it is not known how many clock pulses of clock 1 will occur, nor is it known how many clock pulses of clock 2 will occur. Both sequences may be identical, or either one may exceed the other. Because of this randomness, it will not be known what will be the output number to appear on the dice. Additionally, since the timing pulse *t* also varies in duration, this adds to the randomness. Finally, the inherent changes in the components due to atmospheric conditions may further introduce random effects which will further enhance the effectiveness of the circuitry.

The two sequences of clock signals are respectively taken from the multivibrator through the diode 102 to provide the clock signal number 1, and through the diode 104 to provide the clock signal number 2. The diodes are poled to prevent the high voltage from the counters from being a source to the multivibrator which would otherwise tend to keep the multivibrator operating constantly.

The voltages source 36 can include the batteries 66, which can typicaly be a few pen light batteries placed within the housing. A second voltage VCC is also provided from the battery across a resistor 106. This latter voltage would be utilized to energize the optoelectronic elements hereinafter to be described, and the voltage is reduced in accordance with the requirements of such optoelectronic element. A main-off switch 26 is included in series with the battery to initially place the electronic dice into operation.

The audible oscillator 54 is connected to the output of the timing circuit 34 and includes a typical oscillator having a first transistor 108 coupled to a second transistor 110 with a feed back capacitor 112 connected between the base of transistor 108 and the collector of transistor 110. Resistor 114 connects the base of transistor 108 to the voltage supply. The output of the oscillator is connected to a speaker 115 having a resistive load 116 connected thereacross. The audible oscillator will simulate the sound of rolling dice during the duration of the timing pulse. It is obvious that, if desired, the audible oscillator can be eliminated from the circuit by merely disconnecting it and removing it without affecting any of the other elements of the circuit. The audible oscillator will, therefore, be recognized as being an optional unit.

Figure 5:
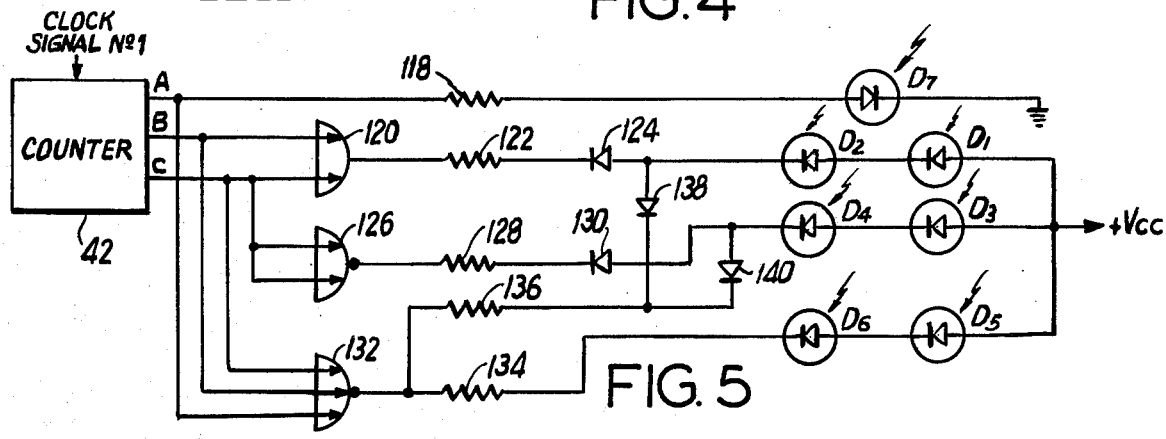
FIG. 5 shows a logic circuit diagram of part of the circuit of FIG. 3, in accordance with the present invention.

The clock pulses from the multivibrator are fed to counters. One such counter 42 is shown in FIG. 5 as receiving the clock signal number 1. The counter is a binary counter which has three output binary lines, identified as A, B, and C. The counter is arranged to repetitively count up to a predetermined value. In this case, the counter is set to count from zero through five, a total of six count. The zero is utilized to represent the highest number, namely six.

Figures 6A, 6B, 6C, 6D:
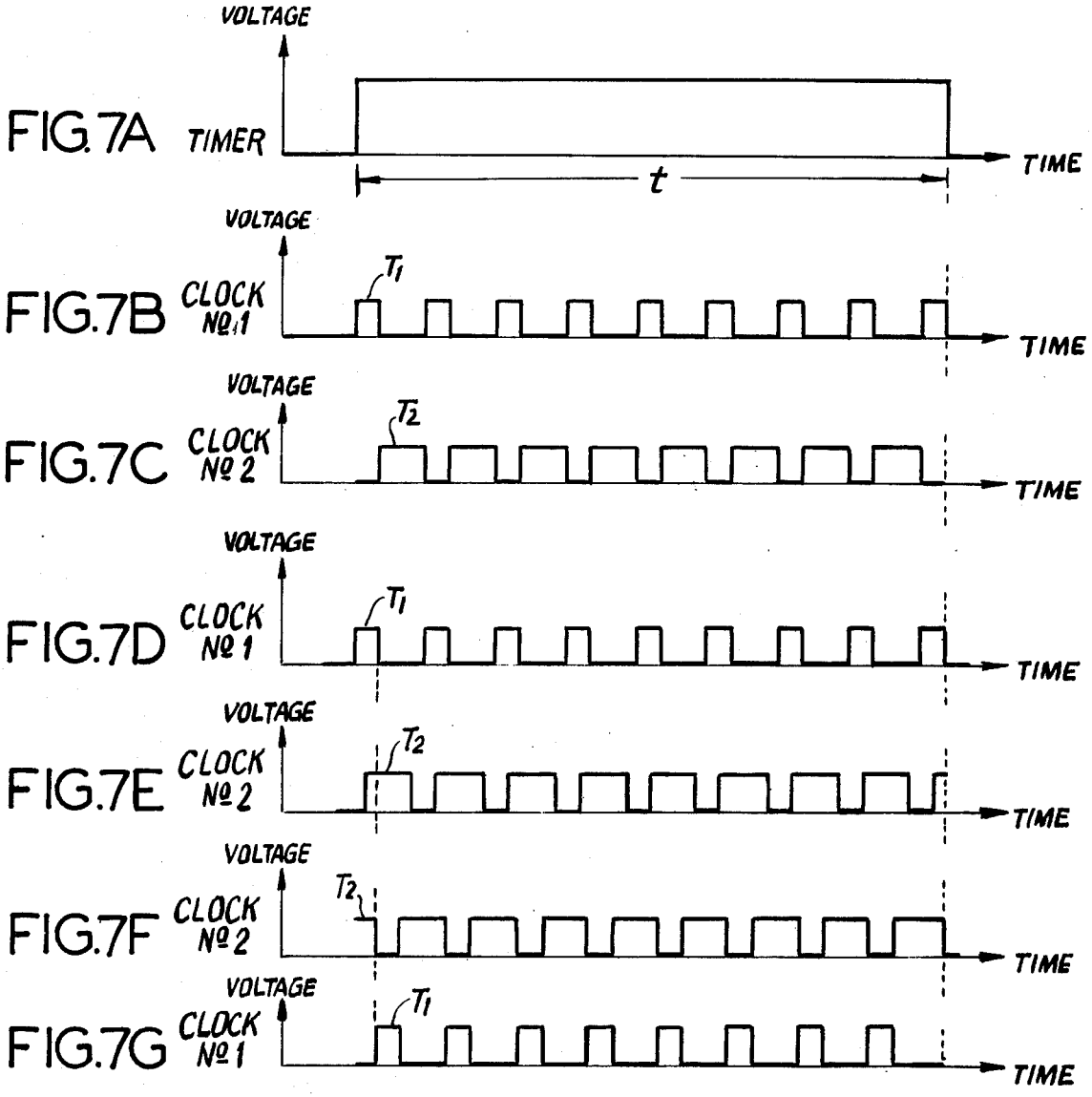
FIGS. 6A–6D shows truth tables and charts for use in explaining the operation of the present invention.

Referring to FIG. 6A, there is shown a chart of the usual binary output of a counter for the six counts, zero-five. For example, at the count of zero, all three outputs A, B and C will be a zero or at the low value. For the count of one, the A output will be a one, or a high value, while the outputs on lines B and C will be zero, or a low value. In a similar manner, each of the output lines A, B and C will produce a particular output for each of the six counts.

Referring again to FIG. 5, it is noted that the optoelectronic elements D1 and D2 are serially connected into a first group; the optoelectronic elements D3 and D4 are serially interconnected into a second group, and the optoelectronic elements D5 and D6 are serially connected into a third group. One end shown as the positive end, of each of these groups are connected to the positive terminal of the voltage source VCC. The seventh optoelectronic element D7 is by itself, and is positioned in reverse to the optoelectronic elements and has its opposite end connected to the other terminal of the voltage supply, typically ground.

The A output line of the counter is directly connected through resistor 118 to the element D7. The B and C lines pass through NOR gate 120 to the first group of elements D1, D2 through the resistor 122 and the reverse poled diode 124. The output line C is used to feed both inputs of NOR gate 126 which is connected to the second group of diodes D3, D4 through the resistor 128 and the reverse poled diode 130. All three output lines A, B and C are utilized as three inputs to an OR gate 132 which directly feeds the optoelectronic elements D5, D6 through resistor 134, and also feeds both the groups D1, D2 through resistor 136 and reverse poled diode 138, as well as the groups D3, D4 through resistor 136 and reverse poled diode 140.

The operation of the circuit shown in FIG. 5 can best be understood in conjunction with the truth tables shown in FIGS. 6B and 6C and the chart shown in 6D. When the counter 42 receives a first pulse representing the digit "one", line A will have a 1 output and lines B and C will have a 0 output. The "one" on line A will serve as a source of voltage to energize the optoelectronic element D7, whose other end is grounded, thereby turning on the central spot D7. Since both lines B and C are zero, the output of NOR gates 120 and 126 will both be a 1. However, this voltage will be locked by the diodes 124 and 130. Furthermore, the voltage VCC passing through the elements D1, D2, D3 and D4 will not be able to pass through these NOR gates, which have high voltage at their output, so that these elements will remain off. The OR gate 132 will have a one at its output which will prevent the voltage VCC from passing through D5 and D6 since it cannot pass through the high voltage output at the OR gate 132. Therefore, for the digit "1" the only element to be displayed will be the element D7.

For the digit "2", the only lne with a one output is line B; the other lines, A and C, being zero. As a result, line A will not be able to turn on D7. The output from the NOR gate 120 will be a zero. This will permit the voltage VCC to pass through the elements D1, D2 and through the NOR gate 120 thereby turning them on. NOR gate 126 will have a one output which will prevent the elements D3, D4 fromturning on. Similarly, OR gate 132 will have a one output while will prevent the elements D5 and D6 from turning on. Therefore, for the digit "2"only the elements D1 and D2 will be turned on, which will display two spots on the face of the dice.

For the digit "3", both lines A and B have a one whereby D7 will be turned on as well as D1 and D2. NOR gate 126 will still have a one output, as will OR gate 132 which will prevent the elements D3, D4 and D5, D6 from turning on.

For the digit "4", the only line with a 1 output will be the C line. Therefore, the NOR gate 126 will have a zero output permitting the elements D3, D4 to turn on. Also, NOR gate 120 will have a zero output permitting the elements D1, D2 to turn on. Elements D7 as well as D5 and D6 will remain off.

For the digit "5", both lines A and C will have a one such that the element D7 will turn on from the voltage on line A, and both NOR gates 120 and 126 will have a zero output permitting the voltage from VCC to pass through the elements D1, D2 and D3, D4. The output from OR gate 132 will still be a one preventing D5 and D6 from turning on.

When a digit "0"is counted, it is used to represent the number six on the dice. In this case, all three lines will be zero. Element D7 will not turn on, and both NOR gates 120 and 126 will have a one output which will prevent the voltage VCC from passing therethrough. However, in this case the OR gate 132 will have a zero output which will permit the voltage VCC to pass through elements D5 and D6. Additionally, the voltage will also pass through elements D1, D2 through the diode 138 and also through the elements D3 and D4 through the diode 140 thereby turning on all six diodes D1–D6, representing the usual six spots of a die.

The reverse poled diodes 138 and 140 are required to prevent the elements D5 and D6 from turning on by having current pass therethrough and up into the NOR gate 120 or 126. It will be appreciated that the counter serves as a "source" of voltage to the optoelectronic element D7 while serving as a "sink" or ground for the elements D1–D6. Of course, each of these elements could be reversed and the voltages applied thereto also reversed to likewise reverse the source and sink arrangement from the counter.

By using the arrangement shown in FIG. 5, it is possible to produce the circuit shown utilizing a minimum number of integrated circuit chips. For example, if two dice were being displayed, the entire FIG. 5 could be duplicated for the second die. With such two circuits, a total of three and two thirds chips are all that is needed for the entire logic portion of the circuit. For example, each counter can be formed on a single chip, making a total of two chips. All the four NOR gates could be provided on a single chip, making a total of three chips. The two OR gates could be formed on a single chip having three triple input OR gates. Therefore, since only two OR gates are actually needed, only two thirds of this chip is used, making a total of three and two thirds chips. Typical chips utilized for this purposes are as follows. The counter can be a 7490 chip; the NOR gate canbe a 7402 chip, and the OR gate can be a 7418 chip. The reduced number of chips required to fabricate the circuit makes it extremely inexpensive, compact, and easy to produce. At the same time, it provides an extreme amount of randomness to the dice and makes electronic dice feasible and useful.

Although the aforementioned description mentioned the use of only a pair of dice in the display, it is understood that additional optoelectronic elements can be included together with additional logic circuitry to provide as many dice as is desired. Also, while the aforementioned description had the dice continuously display the charging state of the counter during the course of each timing pulse, it is understood that the display could be arranged to only display the final output of the counter and not its intermediate states during the course of each timing pulse. However, this would detract from the psychological effect representing the rolling dice. While two countes have been described, a single counter could also be used with switching means to interconnect the input of the counter to each of the two clock pulses, and also interconnect the output of the counter to the two displays. Furthermore, the logic heretofore described is such as to produce minimum components. However, slight modification could also be made without varying the concept of the invention. The optoelectric elements could be light emitting diodes, liquid crystals, luminescent bulbs, or the like. A remote control switch could be placed in parallel with the control switch button 40, using the remote control jack 30, shown in FIGS. 1 and 4. The remote control switch could include an extension cord to permit placing the housing at a central location in the table and having the remote control switch passed around to the various players to give each an opportunity to "roll" the dice. Furthermore, the face of the housing could be directly built into a game board such as the playing field of a backgammon set and be incorporated as part of the construction of the game itself.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A pair of electronic dice comprising, a single timing means for producing pulses of varying duration;

control switch means coupled to said timing means for controlling the beginning and duration of said timing pulses;

switching circuit means responsive to said single timing means and including a single unbalanced multivibrator for providing two random sequences of clock pulses during the duration of each of said timing pulses;

counting means coupled to the output of said switching circuit means for repetitively counting to a predetermined count, said counting means producing an output count for each sequence of clock pulses during each said timing pulse, said output count being dependent upon the total number of clock pulses in that sequence for that timing pulse, and display means coupled to said counting means for displaying the output count for each sequence at the termination of each timing pulse.

2. Electronic dice as in claim 1, and wherein said display means continuously displays the counting state of said counting means throughout the duration of each timing pulse.

3. Electronic dice as in claim 1, and wherein said display means includes optoelectronic devices positioned to represent the spots on a die.

4. Electonic deice as in claim 3, and wherein said optoelectronic devices are light emitting diodes.

5. Electronic dice as in claim 3, and wherein there are included at least sevel optoelectronic devices positioned in two columns of three devices each, and one central device located at approximately the mid point between the two columns.

6. Electronic dice as in claim 5, and wherein one pair of diagonally opposed optoelectric devices are respectively identified as a first and second device, the other pair of diagonally opposed optoelectronic devices are respectively identified as a third and fourth device, the middle optoelectronic devices of each column are respectively identified as the fifth and sixth device, and the central optoelectronic device is identified as the seventh device, said counting means being capable of counting up to six output counts of which a first output count is coupled to said seventh device, a second output count is coupled to said first and second devices, a third output count is coupled to said first, second and seventh devices, a fourth output count is coupled to said first, second, third and fourth devices, a fifth output count is coupled to said first, second, third fourth and seventh devices, and a sixth output count is couple to said first, second, third, fourth, fifth and sixth devices.

7. Electronic dice as in claim 6, and further comprising interface logic circuit means coupled between said counting means and said display means.

8. Electronic dice as in claim 7, and wherein said counting means is a binary counter having at least three binary output lines, a first output line being connected to said seventh device, and wherein said interface logic circuit means includes first NOR gate means coupled from the second and third output lines to said first and second devices, a second NOR gate means coupled from the third output line to said third and fourth devices, and an OR gate means coupled from all three output lines to said first, second, third, fourth, fifth and sixth devices.

9. Electronic dice as in claim 8, and wherein said first and second deivces are serially coupled together in a first group, said third and fourth devices are serially coupled together in a second group, said fourth and fifth devices are serially coupled together in a third group, and further comprising a first diode coupled between said first NOR gate means and said first group, a second diode coupled between said second NOR gate means and said second group, a third diode coupled between said OR gate means and said first group and a fourth diode coupled bwteen said OR gate means and said second group, said third group being directly coupled to said OR gate means.

10. Electronic dice as in claim 9, and further comprising DC voltage source means, one end of said first, second and third groups being coupled to one side of said DC voltage source means, and an opposite end of said seventh device being coupled to the other side of said DC voltage source means, whereby said counter means serves as a "source" for said seventh device and a "sink" for said first, second and third groups.

11. Electronic dice as in claim 10, and further comprising resistor means connected between each of said gate means and the respective diode connected thereto, as well as between said OR gate means and said third group of devices, and said first output line and said seventh device.

12. Electronic dice as in claim 8, and wherein said counter is a three bit counter.

13. Electronic dice as in claim 12, and wherein there are two counting means, two display means, and two logic interface circuit means, each said logic interface circuit means respectively interconnecting a counting means with a display means, and wherein said binary counter is formed on a respective integrated circuit chip, all said NOR gate means are formed on a single integrated circuit chip, and all said OR gate means are formed on a single integrated circuit chip.

14. Electronic dice as in claim 1, and further comprising means for separating said alternating output pulses to form said two varying sequences of clock pulses.

15. Electronic dice as in claim 1, and further comprising a voltage source means, and wherein said timing means includes capacitor means interconnected to said voltage source means through said control switch means, and coupling circuit means interconnected between said voltage source means and said switching circuit means, and operated by said capacitor means, whereby said capacitor means is charged from said voltage source means when said control switch means is closed, and when said control switch means is opened said capacitor means operates said coupling circuit means to energize said switching circuit means until said capacitor means is discharged.

16. Electronic circuit as in claim 1, and further comprising sound producing means coupled to said timing means for producing a sound during the duration of said timing pulse, and wherein said sound simulates the sound of rollin dice.

17. Electonic dice as in claim 16, and wherein said sound producing means includes an oscillator means and a speaker means coupled to the output of said oscillator means.

18. Electronic dice as in claim 1, and further comprising housing means containing said timing means, said switching circuit means and said counting means, and wherein said control switch means is externally manipulated from the exterior of said housing means, and wherein said display means is externally viewable from the exterior of said housing means.

19. Electronic device as inclaim 18, and further comprising a remote ouput terminal connected in parallel across said control switch means and externally available from said housing means.

20. Electronic device as in claim 1, and further comprising voltage source means interconnected to energize said timing means, and main switch means serially interconnected between said voltage source means and said timing means.

* * * * *